US006244890B1

(12) United States Patent
Fuerst et al.

(10) Patent No.: US 6,244,890 B1
(45) **Date of Patent: *Jun. 12, 2001**

(54) MALE ELECTRICAL CONNECTOR FOR FLAT FLEXIBLE CIRCUIT

(75) Inventors: Robert M. Fuerst, Maple Park; Yves LePottier, Geneva; Russell J. Watt, Chicago, all of IL (US)

(73) Assignee: Molex Incorporated, Lisle, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,831

(22) Filed: Mar. 27, 1998

(51) Int. Cl.[7] ..... H01R 13/627

(52) U.S. Cl. ..... 439/357; 439/352; 439/492; 439/495

(58) Field of Search ..... 439/352, 354, 439/357, 492, 495, 496

(56) References Cited

U.S. PATENT DOCUMENTS

| | | | | |
|---|---|---|---|---|
| 3,602,870 | | 8/1971 | Willard . | |
| 3,825,878 | | 7/1974 | Finger et al. . | |
| 4,534,608 | * | 8/1985 | Scott et al. | 339/91 |
| 4,629,271 | * | 12/1986 | Awano | 339/75 |
| 4,802,866 | | 2/1989 | Balzano et al. . | |
| 5,104,253 | * | 4/1992 | Zielinski et al. | 403/329 |
| 5,116,239 | * | 5/1992 | Siwinski | 439/497 |
| 5,295,855 | * | 3/1994 | Walz | 439/354 |
| 5,370,550 | * | 12/1994 | Alwine et al. | 439/352 |
| 5,383,788 | | 1/1995 | Spencer | 439/67 |
| 5,397,247 | * | 3/1995 | Aoki et al. | 439/496 |
| 5,486,117 | * | 1/1996 | Chang | 439/357 |
| 5,529,502 | | 6/1996 | Peltier et al. | 439/67 |
| 5,584,719 | * | 12/1996 | Tsuji et al. | 439/354 |
| 5,830,008 | * | 11/1998 | Broschard, III | 439/557 |
| 5,924,891 | * | 7/1999 | Benjamin et al. | 439/495 |
| 5,928,029 | * | 7/1999 | Lam | 439/497 |
| 6,146,190 | * | 11/2000 | Fuerst et al. | 439/496 |

FOREIGN PATENT DOCUMENTS

| | | | |
|---|---|---|---|
| WO 97/29526 | 8/1997 | (WO) | H01R/9/07 |

* cited by examiner

*Primary Examiner*—Paula Bradley
*Assistant Examiner*—Truc Nguyen
(74) *Attorney, Agent, or Firm*—Stacey E. Caldwell

(57) ABSTRACT

A connector is provided for electrically interconnecting the conductors of a flat flexible circuit to the conductors of a complementary mating connecting device. The connector includes a body member on which the flexible circuit is positioned. A latch arm projects from the body member for latching the connector to the complementary mating connecting device. A resilient web joins the latch arm to the body member for performing the functions of providing an anti-overstress structure and a spring device for the latch arm, as well as an anti-snagging feature for the connector.

20 Claims, 3 Drawing Sheets

MALE ELECTRICAL CONNECTOR FOR FLAT FLEXIBLE CIRCUIT

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of connectors have been designed over the years for terminating or interconnecting flat flexible circuits with complementary mating connecting devices. Major problems continue to plague such connectors, particularly in the area of cost and reliability. Not only is the direct material costs of such connectors unduly high, but an undue amount of labor time is required in assembling such connectors. The present invention is directed to solving these problems by providing an extremely simple, inexpensive and reliable connector structure not heretofore available. However, the concepts of the present invention may be applicable for a variety of electrical connectors other than those specifically designed for a flat flexible circuit.

SUMMARY OF THE INVENTION

An object, therefore, of the invention is to provide a new and improved electrical connector, such as a connector for flat flexible circuitry.

In the exemplary embodiment of the invention, a new and improved male connector is shown for electrically interconnecting the conductors of a flat flexible circuit to the conductors of a complementary mating connecting device. However, the concepts of the invention are not limited to male connectors. The connector includes a body member on which the flexible circuit is positioned, with the conductors of the circuit facing away from the body member. At least one cantilevered latch arm projects from the body member for latching the male connector to the complementary mating connecting device. A resilient web is joined between the latch arm and the body member. The resilient web performs the functions of providing an anti-overstress means and a spring means for the cantilevered latch arm as well as acting as an anti-snagging feature of the connector.

As disclosed herein, the body member, including the latch arm, is unitarily molded of relatively rigid plastic material, and the resilient web is fabricated of an elastomeric material such as silicone rubber. The resilient web may be molded substantially about the cantilevered latch arm near a distal end thereof. The body member may be elongated, and including a pair of the latch arms and a corresponding pair of the resilient webs at opposite ends of the body member.

Other objects, features and advantages of the invention will be apparent from the following detailed description taken in connection with the accompanying drawings.

BREIF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
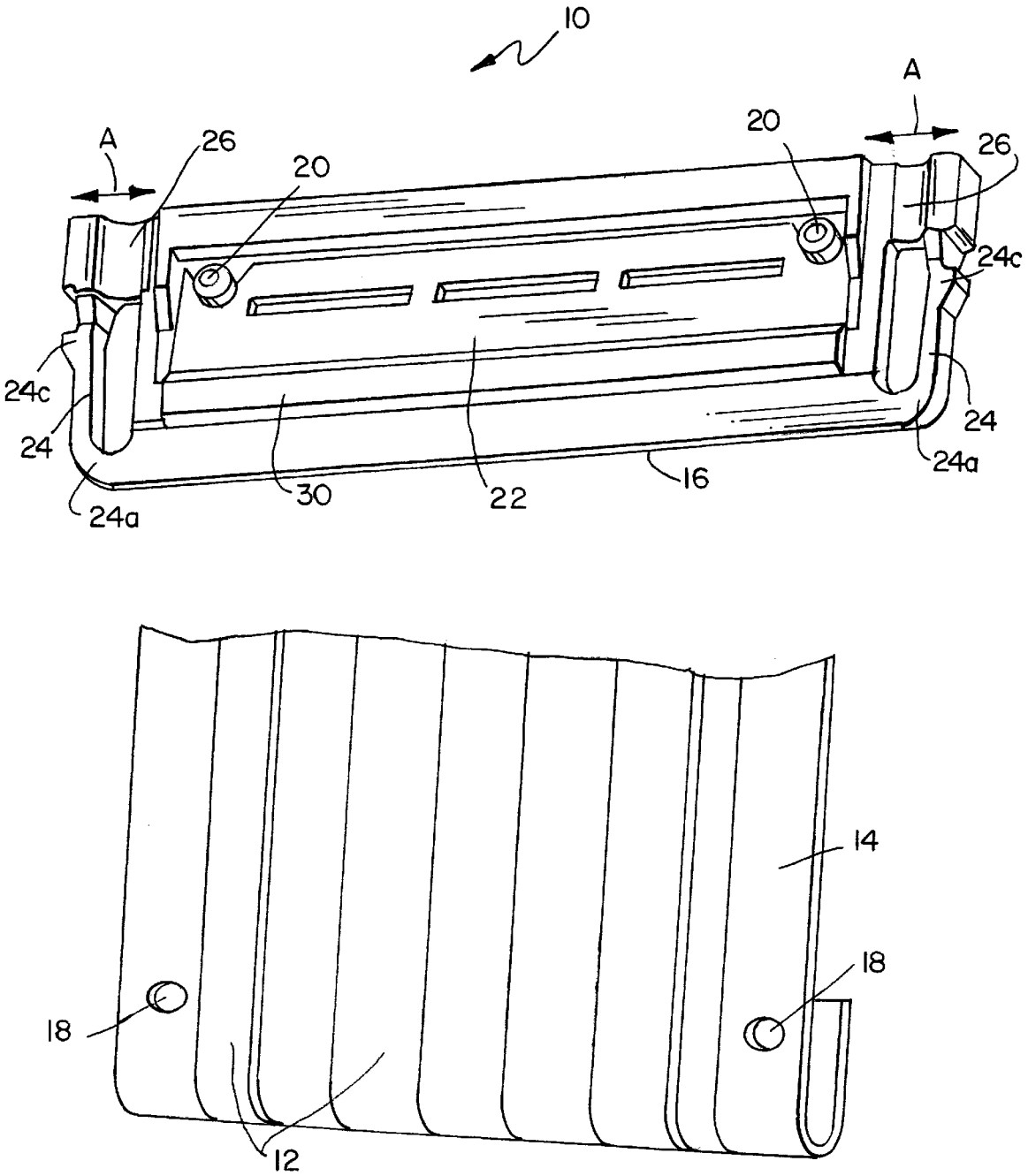
FIG. 1 is a perspective view of a male connector for a flat flexible circuit and incorporating the concepts of the invention.

Referring to the drawings in greater detail, a male connector, generally designated 10, is shown for electrically interconnecting the conductors 12 of a flat flexible cable 14 to the conductors of a complementary mating connecting device (not shown). For instance, male connector 10 can be mated with a complementary female connector by inserting a leading edge 16 of the male connector into an appropriate receptacle of the female connector. In some applications, the male connector could be connected to another complementary male connector. In these various applications, flat flexible cable 14 is wrapped around leading edge 16 of the connector, and locating holes 18 in the cable are positioned over locating posts 20 on opposite sides of the male connector.

Figure 2:
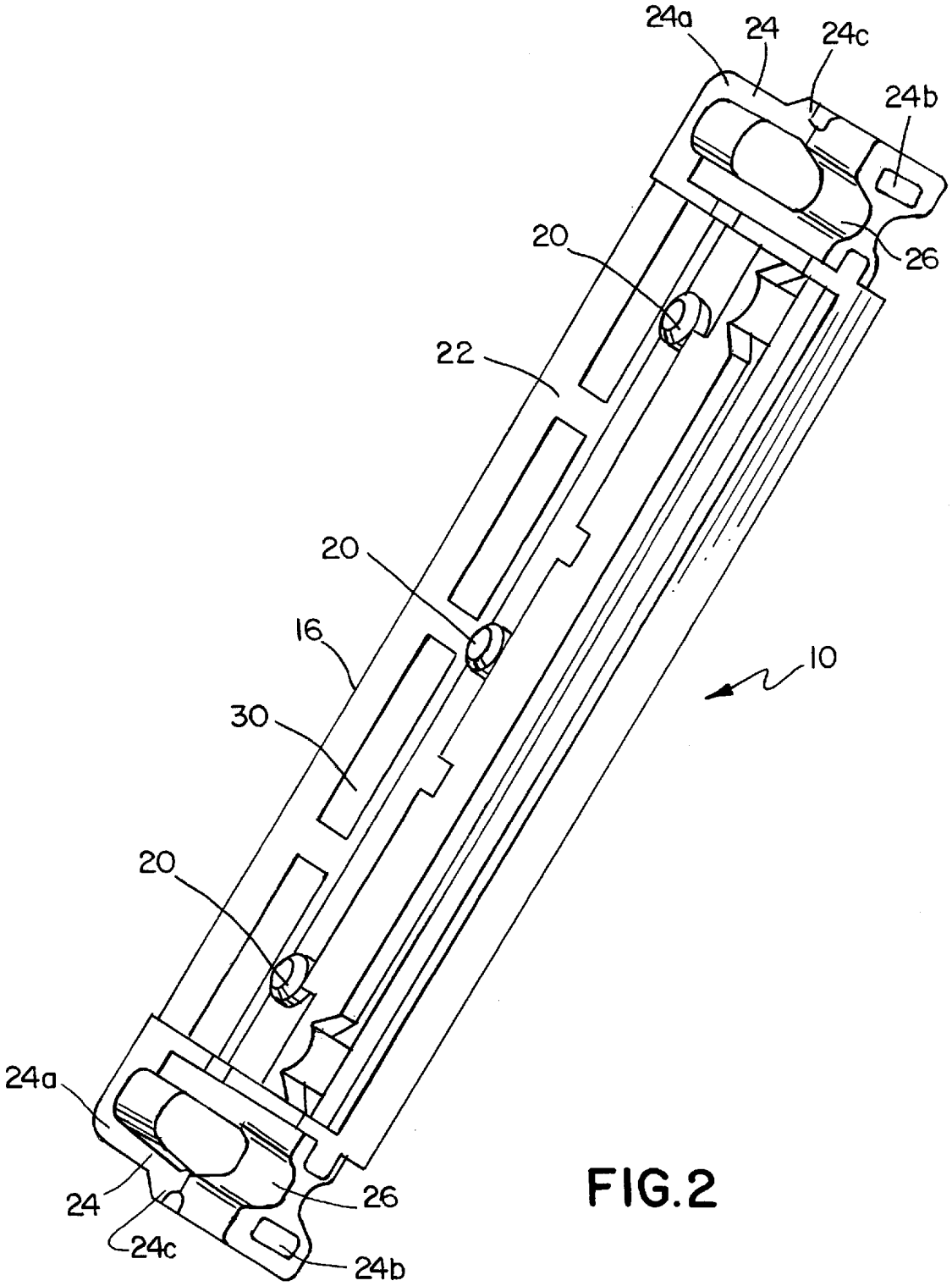
FIG. 2 is a perspective view of the rear of the connector.
Figure 3:
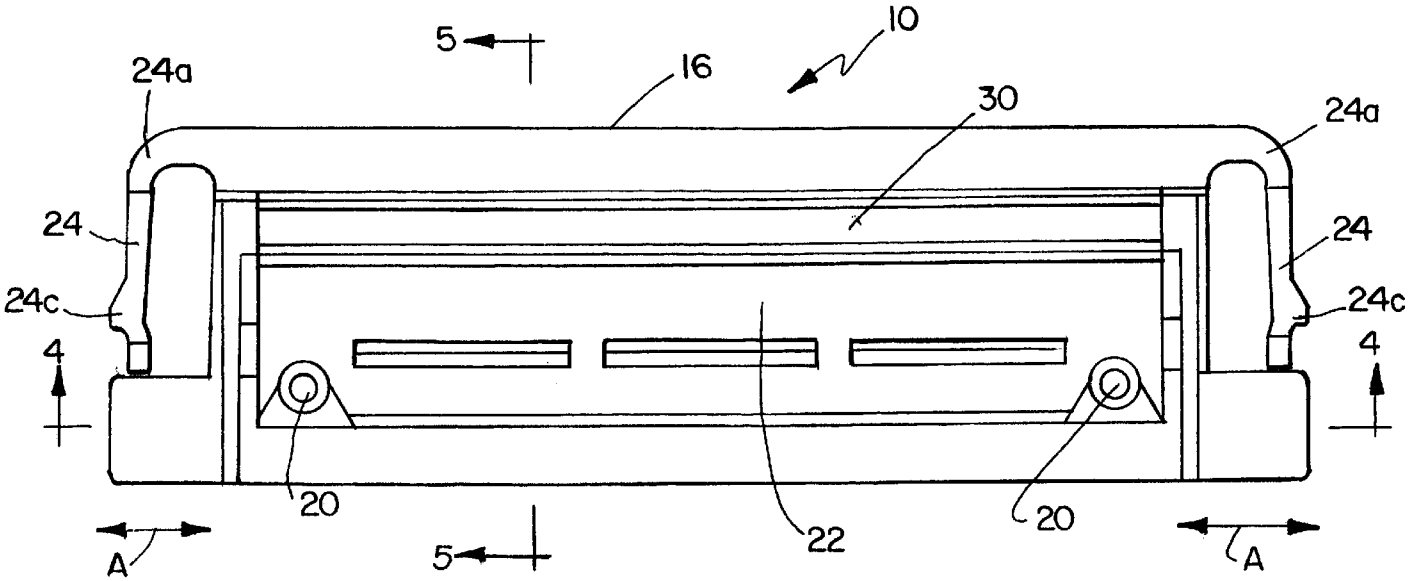
FIG. 3 is a top plan view of the connector.

More particularly, male connector 10 includes a male body member 22 about which flat flexible cable 14 is wrapped. The male body member is generally flat and elongated and includes a pair of cantilevered latch arms 24 at opposite ends thereof. The body member, including the latch arms, is unitarily molded of relatively rigid dielectric material such as plastic or the like. Cantilevered latch arms 24 are joined to the body member at proximal ends 24*a* of the latch arms near opposite ends of leading edge 16 of the connector. Therefore, free ends 24*b* (FIG. 2) of the latch arms can flex in the direction of double-headed arrows "A" (FIGS. 1 and 3). Finally, a pair of latch hooks 24*c* project outwardly of latch arms 24 for engagement with appropriate latch means on the complementary mating connecting device.

The invention contemplates the provision of a resilient web 26 which is joined between each latch arm 24 and the adjacent end of body member 22. For maximum benefit, the webs are joined between distal ends 24*b* of the latch arms and opposite ends of the elongated body member. The resilient webs perform a dual function of providing an anti-overstress means as well as a spring means for the cantilevered latch arms. In other words, the latch arms cannot be pulled excessively away from opposite ends of the body member because of the constraints of the resilient webs. Such pulling action otherwise could overstress and actually break the latch arms. In addition, the resilient webs provide auxiliary spring means for the latch arms. With the latch arms being molded of relatively rigid plastic material, over time and under continuous use the plastic material of the latch arms lose their flexibility, whereas resilient webs 26 continue to provide a necessary spring means. Finally, since the webs are contiguous between each latch arm and the adjacent end of the body member, nothing can easily enter the area between those two features and therefore the webs also provide an "anti-snagging" feature that minimizes interference during assembly of the connector.

Figure 4:
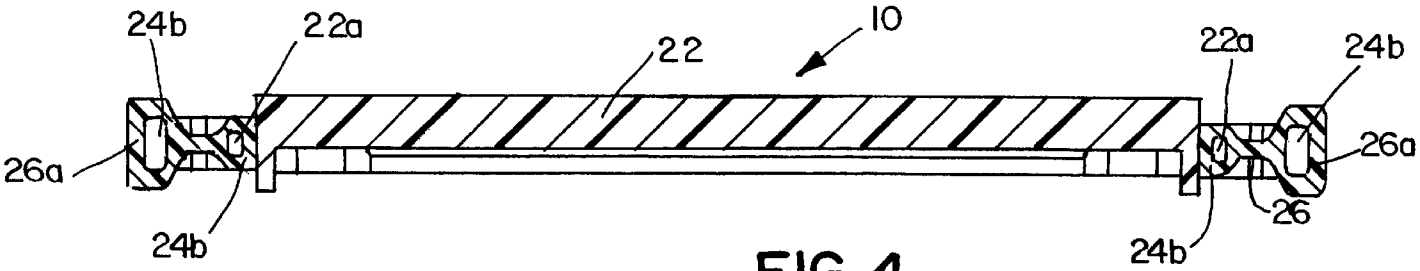
FIG. 4 is a vertical section taken generally along line 4—4 of FIG. 3.

It is contemplated that resilient webs 26 comprise molded-in-place components which can be either insert molded on male body member 22, or the webs and the body member can be simultaneously molded as a "two-shot" injection process. It can be seen in FIG. 4 that the resilient webs have portions 26*a* molded about distal ends 24*b* of the latch arms. The webs also have portions 26*b* molded about integral rib portions 22*a* of body member 22. The webs, including portions 26*a* and 26*b* thereof, can be molded of elastomeric material, such as silicone rubber.

Figure 5:
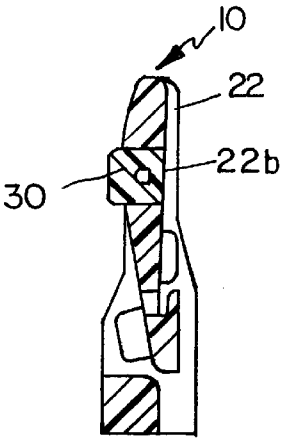
FIG. 5 is a vertical section taken generally along line 5—5 of FIG. 3.

Finally, a yieldable backing structure 30, such as of silicone rubber or other elastomeric material, also can be molded-in-place simultaneously with the molding of resilient webs 26. The yieldable backing structure can be molded about a rib 22*b* of body member 22 as seen in FIG. 5. The yieldable backing structure, thereby, lies beneath flexible circuit 14 for resiliently biasing conductors 12 of the circuit against the conductors of the mating connecting device when male connector 10 is mated with the device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A male connector for electrically interconnecting the conductors of a flat flexible circuit to the conductors of a complementary mating connecting device, comprising:

a generally elongated male body member having a leading edge about which the flexible circuit is adapted to be wrapped;

at least one locating post integrally formed on the male body member adapted to receive a corresponding hole in the flexible circuit;

a cantilevered latch arm projecting from each side of the body member for latching the male connector to the complementary mating connecting device; and a resilient web joined between each latch arm and the body member, wherein the male connector is unitarily molded thereby constituting a one-piece connector.

2. The male connector of claim 1 wherein said resilient web comprises a molded-in-place component.

3. The male connector of claim 2 wherein said body member, including said latch arm, is unitarily molded of plastic material and the resilient web is of elastomeric material.

4. The male connector of claim 2 wherein said resilient web is molded substantially about the cantilevered latch arm near a distal end thereof.

5. The male connector of claim 1 wherein said body member, including said latch arm, is unitarily molded of relatively rigid plastic material.

6. The male connector of claim 1 wherein said resilient web is an elastomeric rubber structure.

7. The male connector of claim 1 wherein said body member is elongated, and including a pair of said cantilevered latch arms and a corresponding pair of said resilient webs at opposite ends of the body member.

8. A connector for electrically interconnecting the conductors of a flat flexible circuit to the conductors of a complementary mating connecting device, comprising:

a generally elongated body member having a leading edge about which the flexible circuit is adapted to be wrapped;

at least one locating post integrally formed on the body member adapted to receive a corresponding hole in the flexible circuit;

a flexible latch projecting from each side of the body member for latching the connector to the complementary mating connecting device; and a resilient web joined between each flexible latch and the body member, wherein the connector is unitarily molded thereby constituting a one-piece connector.

9. The connector of claim 8 wherein said resilient web comprises a molded-in-place component.

10. The connector of claim 9 wherein said body member, including said flexible latch, is unitarily molded of plastic material and the resilient web is of elastomeric material.

11. The connector of claim 9 wherein said flexible latch comprises an arm having a distal end, and the resilient web is molded substantially about the distal end.

12. The connector of claim 8 wherein said body member, including said flexible latch, is unitarily molded of relatively rigid plastic material.

13. The connector of claim 8 wherein said resilient web is an elastomeric rubber structure.

14. The connector of claim 8 wherein said body member is elongated, and including a pair of said flexible latches and a corresponding pair of said resilient webs at opposite ends of the body member.

15. An electrical connector for mating with a complementary mating connecting device, comprising:

a generally elongated body member;

a locating post integrally formed on the body member adapted for positioning a circuit element wrapped around an edge of the body member;

a flexible latch projecting from each side of the body member for latching the connector to the complementary mating connector device; and a resilient member joined between the respective flexible latch and the body member, wherein the electrical connector is unitarily molded thereby constituting a one-piece connector.

16. The electrical connector of claim 15 wherein said resilient member comprises a molded-in-place component.

17. The electrical connector of claim 16 wherein said body member, including said flexible latch, is unitarily molded of plastic material and the resilient member is of elastomeric material.

18. The electrical connector of claim 15 wherein said body member, including said flexible latch, is unitarily molded of relatively rigid plastic material.

19. The electrical connector of claim 15 wherein said resilient member is an elastomeric rubber structure.

20. The electrical connector of claim 15 wherein said body member is elongated, and including a pair of said flexible latches and a corresponding pair of said resilient members at opposite ends of the body member.

* * * * *